United States Patent [19]

Chang et al.

[11] Patent Number: 4,489,150

[45] Date of Patent: Dec. 18, 1984

[54] ELECTROPHOTOGRAPHIC POLYESTER TONER BLENDS

[75] Inventors: Shaw-Ping Chang, San Jose; Paul Shieh, Fremont, both of Calif.

[73] Assignee: Ricoh Company, Ltd., Tokyo, Japan

[21] Appl. No.: 502,256

[22] Filed: Jun. 8, 1983

[51] Int. Cl.[3] ..... G03G 9/08

[52] U.S. Cl. ..... 430/106; 430/109; 525/425

[58] Field of Search ..... 430/106, 109; 525/425

[56] References Cited

U.S. PATENT DOCUMENTS

| | | | |
|---|---|---|---|
| 4,271,249 | 6/1981 | Gilliams et al. | 430/109 X |
| 4,288,516 | 9/1981 | Gaudioso | 430/109 X |
| 4,331,755 | 5/1982 | Gilliams et al. | 430/109 X |

FOREIGN PATENT DOCUMENTS

| | | | |
|---|---|---|---|
| 2082788 | 3/1982 | United Kingdom | 430/109 |
| 2091897 | 8/1982 | United Kingdom | 430/109 |
| 2100873 | 1/1983 | United Kingdom | 430/109 |

*Primary Examiner*—Roland E. Martin

*Attorney, Agent, or Firm*—Flehr, Hohbach, Test, Albritton & Herbert

[57] ABSTRACT

A novel toner composition with improved thermal and rheological properties, improved surface energy, and better frangibility is provided. The toner comprises a thermoplastic polymeric blend and a coloring agent. The polymeric blend is comprised of propoxylated bisphenol-A fumarate and a polyester resin with a chemically bound halogen. A preferred polyester resin with a chemically bound halogen is tetrabromo-bisphenol fumarate polyester. An improved electrophotographic imaging process using the toner particles of the present invention is also provided.

7 Claims, No Drawings

ELECTROPHOTOGRAPHIC POLYESTER TONER BLENDS

The present invention is directed to novel developing materials for use in electrophotographic imaging processes. Specifically, the present invention is directed to a novel toner composition comprising thermoplastic polymeric blends.

In the electrophotographic art, the formation and development of images on photoconductive materials by electrostatic means may be accomplished by placing a uniform electrostatic charge on the photoconducting layer, exposing the layer to a light and shadow image to dissipate the charge on the areas of the layer exposed to the light, and developing the resulting light and electrostatic image by depositing on the image a finely divided electroscopic material, referred to in the art as "toner". The toner is normally attracted to those areas of the layer which retain the charge, either negative or positive, thereby forming a toner image corresponding to the latent electrostatic image. This toner image may then be transferred to a support surface such as paper and permanently affixed thereto by heat, solvent or overcoating treatment.

The toner is generally comprised of a coloring agent, such as carbon black, dispersed in a thermoplastic polymer. The particular polymer is chosen based upon a number of electrical, chemical, and physical properties, including its triboelectric characteristics, its thermal properties for fusing, its non-adhesion to the photorecepter (for cyclic systems), its viscosity, its molecular weight distribution, and its stability before and after development.

A known polymer, commonly used in toner compositions, is propoxylated bisphenol-A fumarate polyester. Toners containing the polymer have a surface energy of about 23ergs/cm$^2$. The propoxylated bisphenol-A fumarate polyester toners also have a relatively low blocking temperature, indicating a tendency to soften at low temperatures which causes the toner particles to coalesce and may result in a short shelf life. They have a relatively high melt index at temperatures of 135° C. or more and a relatively low Kofler softening temperature, indicating a low viscosity which may result in hot offsetting and the smearing of the copy in a hot fuser roll.

Hot offsetting is the undesirable transfer of toner particles from the developed toner image carried on a support surface or receiving member, such as copy paper, to the surface of the heated fuser roll. Upon further use of the heated fuser roll, the toner particles which have adhered to its surface are transferred to subsequent copy sheets or receiving members. As a result, either a ghost image or previously fixed images is formed on subsequent copy sheets, or undesirable deposits of toner particles are formed in background areas of subsequent copy sheets.

A toner is generally prepared by a method known as melt-blending. The polymer and coloring agent are melted and blended together. The resulting mass is cooled and then ground or broken into particles. The resulting particles are generally passed through the jets of an atomizer to further break up the particles to the desired size. This process is known as jet-pulverization. A toner should be frangible so that it can be easily pulverized.

In the electrophotographic art, there is a substantial problem with hot offsetting and thus there is a continuing need for a toner composition with improved thermal and rheological properties which will eliminate the problem. There is also a need for toners with increased frangibility for ease in jet pulverization, with improved surface energies for better fusion of the toner to the paper, and with a longer, more stable shelf life.

It is therefore an object of the present invention to provide a novel toner composition, comprising a thermoplastic polymeric blend and a coloring agent, which provides improved thermal and rheological properties.

It is also an object of the present invention to provide a toner composition, comprising a thermoplastic polymeric blend and a coloring agent, with an improved surface energy which provides for better fusion of the toner to the paper and prevents hot offsetting.

A further object of the present invention is to provide a toner composition, comprising a thermoplastic polymeric blend and a coloring agent, which has a longer, more stable shelf life and better frangibility.

Another object of the present invention is to provide a toner composition, comprising a thermoplastic polymeric blend and a coloring agent, with a relatively high viscosity so as to eliminate hot offsetting and smearing of the copy.

The present invention provides a novel toner composition comprising a coloring agent and a thermoplastic polymeric blend, comprising propoxylated bisphenol-A fumarate and a polyester resin with a chemically bound halogen. A preferred polyester resin with a chemically bound halogen is tetrabromo-bisphenol fumarate polyester.

Additional objects and features of the invention will appear from the following detailed description of the preferred embodiments.

The present invention provides a toner composition comprising a thermoplastic polymeric blend and a coloring agent, such as carbon black. The polymeric blend comprises propoxylated bisphenol-A fumarate polyester and a polyester resin with a chemically bound halogen. A preferred polyester resin with a chemically bound halogen is tetrabromo-bisphenol fumarate polyester. The toner composition may optionally contain minor amounts of additives. These additives are preferably conventional lubricants and cleaning agents such as metal stearates and silica.

As illustrated in Table 1, the toner composition of the present invention demonstrates improved thermal and rheological properties, such as blocking temperature, Kofler softening temperature, and melt index, and an improved surface energy, as compared to commonly used toner compositions comprised of propoxylated bisphenol-A fumarate polyester alone.

TABLE 1

| Composition* | 1** | 2** |
|---|---|---|
| Blocking, °C. | 47–50 | 57 |
| Kofler Softening, °C. | 77–85 | 84–98 |
| Melt Index, gm/10 min. | | |
| 115° C. | 22.8 | 3.3 |
| 125° C. | 45.0 | 16.2 |
| 135° C. | 128.4 | 64.8 |
| Surface Energy. | 23.0 | 21.5 |

TABLE 1-continued

| Composition* | 1** | 2** |
|---|---|---|
| ergs/cm$^2$ | | |

*All polymeric blends are in a 50:50 wt. ratio with 10% carbon black.
**1 Propoxylated bisphenol-A fumarate polyester
**2 Propoxylated bisphenol-A fumarate polyester and tetrabromo-bisphenol fumarate polyester The blocking temperature of the toner containing the propoxylated bisphenol-A fumarate polyester and tetrabromo-bisphenol fumarate polyester blend (Composition 2) is about 57° C., whereas the toner containing only the propoxylated bisphenol-A fumarate polyester (Composition 1) has a blocking temperature of about 47° C. to 50° C. The higher blocking temperature of the polymeric blend indicates that a toner containing the blend will be less likely to coalesce or decompose on the shelf or in storage than a toner containing only propoxylated bisphenol-A fumarate polyester, because a much higher temperature is required before the toner particles begin to coalesce. Thus, the toner of the present invention will have a longer, more stable shelf life.

Further, the toner containing the polymeric blend (Composition 2) has a Kofler softening temperature range of about 84° C. to 98° C., whereas the toner containing propoxylated bisphenol-A fumarate polyester alone (Composition 1) has a lower softening temperature range of about 77° C. to 85° C., as illustrated in Table 1. The higher softening temperature range of the toner containing the polymeric blend (Composition 2) indicates a higher viscosity, thus the hot offsetting problem is minimized. The lower Kofler softening temperature range of propoxylated bisphenol-A fumarate polyester toner (Composition 1) indicates that the polymer may become too soft at machine temperatures causing it to adhere to the fuser roll rather than the paper. This in turn may cause hot offsetting and smearing of the copy in the hot fuser roll.

The toner comprising the polymeric blend of propoxylated bisphenol-A fumarate polyester and tetrabromo-bisphenol fumarate polyester (Composition 2) has a melt index which is much lower than the melt index of a toner comprised of only propoxylated bisphenol-A fumarate polyester (Composition 1) as illustrated in Table 1. The melt index of the propoxylated bisphenol-A fumarate polyester toner (Composition 1), is 128.4 gm/10 min. at 135° C., indicating that the toner's viscosity is much too low at the temperature, especially in view of the fact that the temperature in an electrophotographic machine may be greater than 135° C. On the other hand, the toner of the present invention (Composition 2) has a melt index of only 64.8 gm/10 min. at 135° C., indicating a higher viscosity at 135° C. The low viscosity of the toner comprised of propoxylated bisphenol-A fumarate polyester at temperatures of 135° C. or more means that the toner will be much too fluid at that temperature and hot offsetting is very likely to occur. The higher viscosity of the toner of the present invention helps to eliminate the hot offsetting problem.

The toner composition of the present invention also has an improved surface energy which results in better fusion of the toner to the paper and thus, a better copy. The surface energy of the present invention, the propoxylated bisphenol-A fumarate polyester and tetrabromo-bisphenol fumarate polyester toner blend (Composition 2), is about 21.5 ergs/cm$^2$, whereas the surface energy of the propoxylated bisphenol-A fumarate polyester toner (Composition 1) is about 23 ergs/cm$^2$. The lower surface energy of the toner containing the polymeric blend is sufficiently higher than the surface energy of the fuser roll and thus, prevents adhesion of the toner to the fuser roll which in turn prevents hot offsetting or smearing of the copy. However, the surface energy of the toner is sufficiently lower than the surface energy of the paper so as to allow for good adhesion and fusion to the paper. The toner containing the polymeric blend, as opposed to a toner comprised of the single polymer, propoxylated bisphenol-A fumarate polyester, demonstrates better adhesion and fusion to the paper, less adhesion to the fuser roll and thus, the elimination of hot offsetting and a smeared copy.

In addition, the present invention demonstrates better frangibility than toner compositions containing the single polymer, propoxylated bisphenol-A fumarate polyester. The polyester resin with a chemically bound halogen serves as an embrittling agent. Thus, the polymeric blend toner of the present invention is more easily pulverized to the desired particle size. After the initial grinding or breaking up of the toner, the particles are passed through jets until the desired particle size is obtained. A desirable particle size for a toner is generally about 12±2 μm. As illustrated in Table 2, it requires only one jetting pass to obtain a desired particle size of 11.0 μm for the toner of the present invention, whereas two jetting passes are required to obtain a particle size of 13.5 μm for the toner containing the single polymer, propoxylated bisphenol-A fumarate polyester.

TABLE 2

| Particle Size Data | Compositions* 1** | 2** |
|---|---|---|
| Number of Jetting Passes | 2 | 1 |
| Total Volume Mean, μm | 13.5 | 11.0 |
| Population Mean, μm | 7.7 | 7.0 |
| % of Population >5 μm | 86.5% | 84% |

*All polymeric blends are in a 50:50 wt. ratio with 10% carbon black.
**1 Propoxylated bisphenol-A fumarate polyester
**2 Propoxylated bisphenol-A fumarate polyester and tetrabromo-bisphenol fumarate polyester Thus, the polymeric blend toner of the present invention demonstrates improved frangibility, which is an advantage over the toner containing the known polymer.

The toner composition of the present invention is prepared by a method known as melt-blending. The method involves melting a powdered form of propoxylated bisphenol-A fumarate and the polyester resin with a chemically bound halogen, preferably tetrabromobisphenol fumarate polyester, and mixing or blending the melted polymers together along with the coloring agent and any other additivies, such as conventional lubricants or cleaning agents. After thorough blending, the mixture is cooled and solidified. The resultant mass is then broken into small particles and finely ground or pulverized to form a free-flowing powder of toner particles having the desired size.

The polymers, propoxylated bisphenol-A fumarate polyester and the polyester resin with a chemically bound halogen, can be blended together in a ratio in the range of about 25:75 to about 75:25 by weight. A preferred blend is 50% by weight propoxylated bisphenol-A fumarate polyester and 50% by weight polyester resin with a chemically bound halogen. The propoxylated bisphenol-A fumarate polyester and the tetrabromo-bisphenol fumarate polyester are commercially available from ICI Americas, Inc.

The coloring agent can be a dye or a pigment, such as carbon black. The amount of coloring agent added may be varied over a wide range of from about 1 to 20% of the weight of the polymeric blend. Particularly good results are obtained when the amount is about ten percent. Additives such as metal stearates and silica may also be incorporated. Generally, if any of the various additives are used in the toner, the total amount should be less than about 2 percent of the weight of the polymeric blend.

The toner of the present invention can be mixed with a carrier vehicle to form developing compositions. The carrier vehicle can be glass beads, crystals of inorganic salts such as sodium or potassium chloride, hard resin particles, or metal particles. Magnetic carrier particles of ferromagnetic materials such as iron, cobalt, nickel, and alloys may also be used, as well as ferromagnetic particles overcoated with a thin layer of various film-forming resins.

In an electrophotographic imaging process, the toner of the present invention is deposited on a latent electrostatic image to form a visible image. The visible image is transferred to a support surface by fusing the toner particles to the support surface.

What is claimed is:

1. A toner composition for electrophotographic developing, comprising a coloring agent and a thermoplastic polymeric blend comprising propoxylated bisphenol-A fumarate polyester and a polyester resin with a chemically bound halogen.

2. A toner composition according to claim 1 wherein said polyester resin with a chemically bound halogen comprises tetrabromo-bisphenol fumarate polyester.

3. A toner composition according to claim 1 wherein said polymeric blend is comprised of from about 25:75 to about 75:25 by weight of said propoxylated bisphenol-A fumarate polyester and said polyester resin with a chemically bound halogen.

4. A toner composition according to claim 1 wherein said polymeric blend is comprised of about 50 percent by weight propoxylated bisphenol-A fumarate polyester and about 50 percent by weight tetrabromo-bisphenol fumarate polyester.

5. A toner according to claim 1 wherein said coloring agent is carbon black.

6. In an electrophotographic imaging process wherein a visible image is produced by contacting a latent electrostatic image with toner particles, and subsequently said visible image is fixed to a suitable receiving support by fusing said toner particles to said support, the improvement comprising the step of contacting said latent electrostatic image with toner particles comprising, a coloring agent and a thermoplastic polymeric blend comprising propoxylated bisphenol-A fumarate polyester and a polyester resin with a chemically bound halogen.

7. An electrophotographic imaging process according to claim 6 wherein said polyester resin with a chemically bound halogen comprises tetrabromo-bisphenol fumarate polyester.

* * * * *

UNITED STATES PATENT AND TRADEMARK OFFICE

CERTIFICATE OF CORRECTION

PATENT NO. : 4,489,150
DATED : December 18, 1984
INVENTOR(S) : Chang, et al.

It is certified that error appears in the above-identified patent and that said Letters Patent are hereby corrected as shown below:

IN THE SPECIFICATION:

Column 1, line 56, replace "or" with --of--.

Column 3, line 48, replace "the" with --that--.

Column 5, line 27, after "surface", insert --,such as paper, and permanently fixed to the support surface--

Signed and Sealed this

*Twenty-first* Day of *May 1985*

[SEAL]

*Attest:*

DONALD J. QUIGG

*Attesting Officer* *Acting Commissioner of Patents and Trademarks*